US006168333B1

(12) United States Patent
Merz et al.

(10) Patent No.: US 6,168,333 B1
(45) Date of Patent: Jan. 2, 2001

(54) PAPER DRIVEN ROTARY ENCODER THAT COMPENSATES FOR NIP-TO-NIP HANDOFF ERROR

(75) Inventors: Eric Alan Merz, Webster; Roger Glenn Teumer, Fairport; Frederick Allen Donahue, Walworth; W. Keith Gilliland; Roger Guy Markham, both of Webster, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/327,612

(22) Filed: Jun. 8, 1999

(51) Int. Cl.[7] ..... B41J 13/02
(52) U.S. Cl. ..... 400/634; 400/579; 400/582
(58) Field of Search ..... 400/634, 579, 400/617, 582, 616

(56) References Cited

U.S. PATENT DOCUMENTS 4,297,716 * 10/1981 Hirayama et al. ..... 346/153.1
4,892,246 1/1990 Steele .
5,075,702 12/1991 Castelli et al. .
5,642,949 * 7/1997 Yamamoto ..... 400/322
5,715,514 * 2/1998 Williams et al. ..... 399/395

* cited by examiner

*Primary Examiner*—John S. Hilten
*Assistant Examiner*—Charles H. Nolan, Jr.
(74) *Attorney, Agent, or Firm*—Oliff & Berridge, PLC

(57) ABSTRACT

A sheet transport system has an encoder roller in direct contact with the sheet media and driven by the sheet media to detect and compensate for any registration error particularly at lead and trail edges during transport of the sheet media as media enters and exits transport nips. The invention is well suited for use in controlling and monitoring paper movement in incremental advance and print systems, such as ink jet printers. A biasing member ensures that the sheet media and encoder roller are in intimate contact. Preferably, a material with a high coefficient of friction is provided on an outer periphery of the encoder roller to assist in mating of the roller with the sheet media.

20 Claims, 4 Drawing Sheets

PAPER DRIVEN ROTARY ENCODER THAT COMPENSATES FOR NIP-TO-NIP HANDOFF ERROR

BACKGROUND OF THE INVENTION

1. Field of Invention

The invention relates to an apparatus for precisely controlling the movement of sheet media between two transport nips of a media transport system. More particularly, the invention relates to the use of a rotary encoder roller in direct contact with the sheet media and driven by the sheet media to detect and compensate for any registration error at lead and trail edges as media enters or exits one of the nips. The invention is well suited for use in controlling and monitoring paper movement in incremental advance and print systems, such as ink jet printers.

2. Description of Related Art

Transport systems for printing apparatus, such as scanning ink jet printers, operate by incrementally advancing sheet media past a printhead. For example, some ink jet printers increment a paper 1", print a 1" swath with the printhead, increment the paper another 1", etc. until an entire page is printed. Such movement needs to be precisely the same distance as the width of a printed swath in order to properly register the image to be printed and prevent visible image defects.

As the printing industry continues to push towards finer and finer levels of resolution, there is a need for increasingly higher levels of precision in the driving of the sheet media. For current 600 spot per inch (SPI) printers, observable defects can occur with misregistration of about 0.5 pixels. As this resolution, this 0.5 pixel error translates into a registration error of about 21 microns.

Many of today's low-cost printers have no feedback control, count motor steps to provide controllable incremental transport, or include a servo-controlled drive structure, such as that illustrated in FIG. 1, provided on a drive roller. In such printers, a sheet media P (such as a cut sheet of paper) is incrementally transported in direction R between first and second drive nip pairs 10, 20 across a platen 50 past a printhead 30. In such conventional devices, the drive nip pair 10 exerts an entrance drive force on the sheet media P by contacting the top and bottom surfaces of the sheet media. Likewise, the drive nip pair 20 exerts an exit drive force on the sheet media P. Each of the nips 10, 20 may include a driven roller element and an idler element. The drive nip pairs 10, 20 may be driven by stepper motors or servo motors that include an encoder 40 that through conventional feedback control provides signals that control rotation of the drive roller of each drive nip pair to transport the sheet media P across platen 50 past the printhead 30. Such transport structures assume that the sheet media P closely follows the rotation of the drive nip pairs 10, 20. An example of such a system is co-pending U.S. Ser. No. 09/233,111 to Tellmer et al. filed Jan. 19, 1999, which is assigned to the same assignee as the present invention and incorporated herein by reference in its entirety.

Traditionally, engineers looking to improve positional accuracy would turn towards higher tolerance components in a drive system. That is, providing motors with higher positional accuracy and higher precision encoders. However, such higher tolerance components can be too costly to implement in low cost printing devices, such as ink jet printers. Moreover, it would be difficult for such systems to achieve high precision transport and high quality image production when such drive systems cannot necessarily identify misregistration of the sheet media being transported.

SUMMARY OF THE INVENTION

Applicants have found that such conventional transport structures can encounter problems in image registration, particularly near leading and trailing edges of the paper. This is primarily believed to be the result of handoff errors that are caused by a discontinuity, such as the paper transitioning from the exit of an input nip to the entrance of an exit nip. At such discontinuities, the paper may slip relative to the rotation of the nips, causing misalignment that cannot be properly sensed or compensated for using this conventional structure. Additionally, alignment errors can be caused by elastomeric nip microslip, which occurs when elastomeric rubber rollers are provided in the transport path and deform dependent on drag applied to the rollers. Such microslip can change as the paper passes through such rollers.

Accordingly, there is a need for other methods and apparatus that can achieve improved sheet media positioning so that observable print defects due to media misregistration can be substantially decreased.

One exemplary embodiment of the invention overcomes such problems by providing an apparatus for regulating sheet media position within a sheet media transport path formed between an upstream transport nip and a downstream transport nip that compensates for error in sheet media position between the upstream transport nip and the downstream transport nip, which are driven by at least one drive mechanism. The apparatus includes an encoder roller, a biasing member, a controller and a feedback mechanism. The encoder roller is rotatably mounted between the upstream transport nip and the downstream transport nip so as to contact one side of sheet media itself as the sheet media is fed through the sheet media transport path. The encoder roller has an outer peripheral surface at least partly formed from a high coefficient of friction material and further includes an encoder member that measures angular rotation of the encoder roller. The biasing member is positioned between the upstream transport nip and the downstream transport nip and is juxtaposed relative to the encoder roller to bias the sheet media against the encoder roller. A combination of the high coefficient of friction material on the encoder roll and a biasing force of the biasing member are selected so as to prevent relative slip between the sheet media and the encoder roller. As such, the encoder roller is driven solely by a driving force created by the sheet media. The controller determines sheet media misregistration, such as by comparing output from the drive system, which controls driving of the nips, with output from the encoder roller. A feedback mechanism can then adjust the drive system or other parameters or components to compensate for any misregistration.

In preferred exemplary embodiments of the invention, the biasing member can be a vacuum platen, a thin flexure pressure finger, or an idler roller. However, other biasing members can be substituted so long as they function to bias the sheet media against the encoder roller without relative slip.

In a particular embodiment of the invention, the apparatus is part of an incremental advance and print printing system, such as an ink jet printer having a printhead located between the upstream and downstream nips to provide an image (black, highlight or full color) onto the sheet media traveling through the nips. The encoder roller is preferably positioned closely adjacent the printing to monitor sheet media position at the point of printing.

BRIEF DESCRIPTION OF THE DRAWINGS

Various exemplary embodiments of this invention will be described in detail with reference to the following figures, wherein.

DETAILED DESCRIPTION OF PREFERRED EMBODIMENTS

Figure 1:
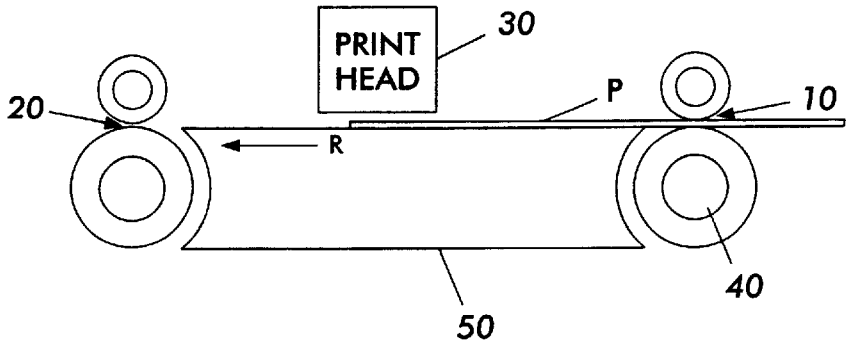
FIG. 1 PRIOR ART
FIG. 1 is a side view of a conventional transport system for an ink jet printer.
Figure 2:
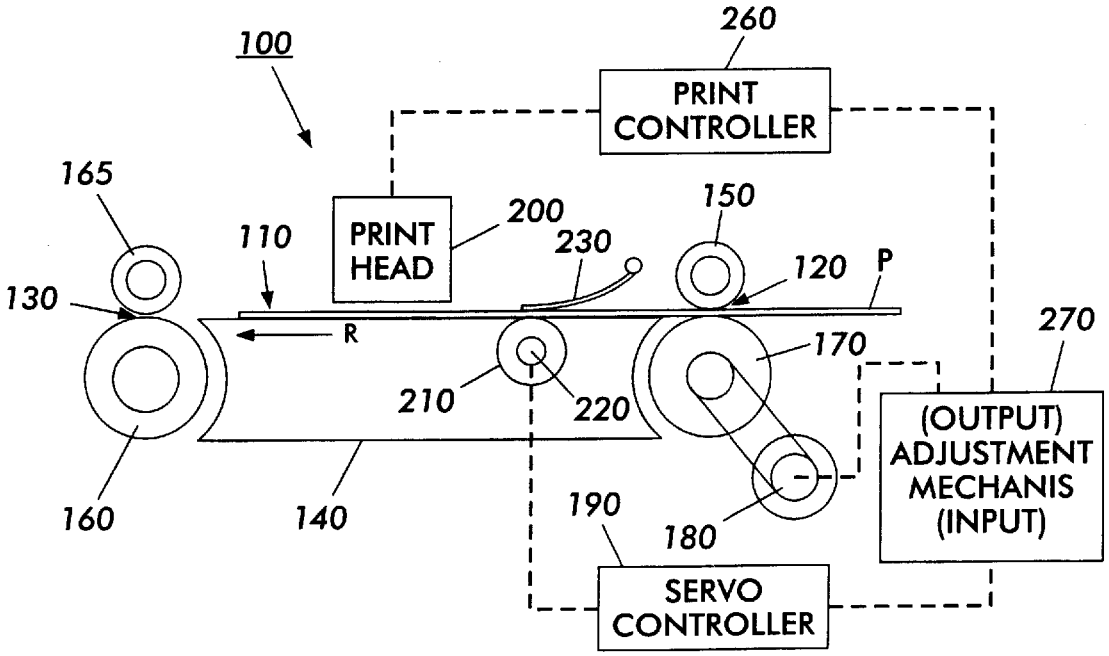
FIG. 2 is a side view of a first exemplary embodiment of the invention.
Figure 3:
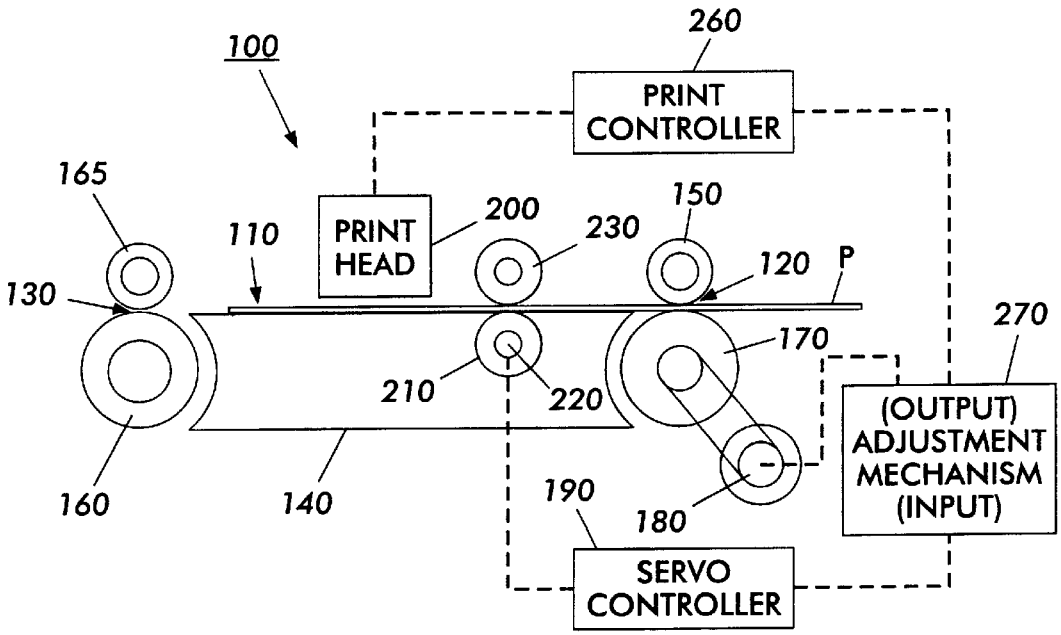
FIG. 3 is a side view of a second exemplary embodiment of the invention.

With reference to FIG. 2, a first exemplary embodiment of the invention will be described. An apparatus 100 for regulating sheet media position can form part of a printing system, such as an ink jet printer, and is provided with a sheet media transport path 110 formed between an upstream transport nip 120 and a downstream transport nip 130. The upstream transport nip 120 is made up of a drive roller 170 and an idler roller 150 spaced in close proximity to drive roller 170 to allow a predetermined sheet media P to be driven therebetween. The downstream transport nip 130 is made up of a drive roller 160 and an idler roller 165.

Drive roller 170 is rotated by a motor 180 suitably coupled to the drive roller 170. Motor 180 is driven to feed sheet media P in a direction R past a platen 140 of a printing system, such as an ink jet printhead 200, which is provided along the transport path 110 opposed to one side of sheet media P for printing an image thereon. The printing system is preferably an incremental advance and print system in which the sheet media P is advanced by a predetermined swath distance, which corresponds to the printable size of the particular printhead 200 used, such as 1". However, the invention is not limited to incremental systems or particular swath advances.

The upstream transport nip 120 can be considered an input nip of the transport path 110, although it does not necessarily have to be the beginning of the entire transport path of the printer and can comprise an intermediate portion thereof. The downstream transport nip 130 can be considered an exit nip of the transport path 10. Similarly, the exit nip of transport path 110 does not have to be an end of the overall transport path of the printer.

An encoder roller 210 is rotatably positioned intermediate the input and exit nip 120, 130. Most preferably, the encoder roller 210 is provided on a shaft 220 and positioned closely adjacent printhead 200 (along the direction R). While placement close to the printhead provides for more accuracy where printing is to occur, this placement may not be as critical in other applications that may not use a printhead. Encoder roller 210 is provided at a position so that an outer peripheral surface of the encoder roller 210 comes in contact with a surface of a sheet media P traveling along the transport path 110. The encoder roller 210 preferably has a diameter of less than about 2 inches when space constraints are of concern; however, a larger diameter can result in better resolution.

At least a part of the outer peripheral surface 210A includes a material having a high coefficient of friction. See FIGS. 7–8. A suitable material is a silicon spray coating on the roller surface. Other materials that can achieve such a friction coefficient include, but are not limited to, rubber or a grit-blasted carburized steel. The high coefficient of friction is desirable to ensure that the encoder roller 210 is driven by the feeding of the sheet media P.

Returning back to FIG. 2, maintaining contact with the sheet media P is further ensured by providing a biasing member 230 that biases the sheet media P against the encoder roller 210. Biasing member 230 can be a pressure finger, such as a Mylar flexure element, provided juxtaposed to encoder roller 210, but on an opposite side of sheet media P to bias the sheet media P therebetween. Other exemplary biasing members can take the form of an idler roller 230 (FIG. 4) or can be achieved by the combination of a vacuum assisted platen 140 fed by a vacuum source 280. The vacuum forces the sheet media P against the belt and subsequently against encoder roller 210.

Figure 4:
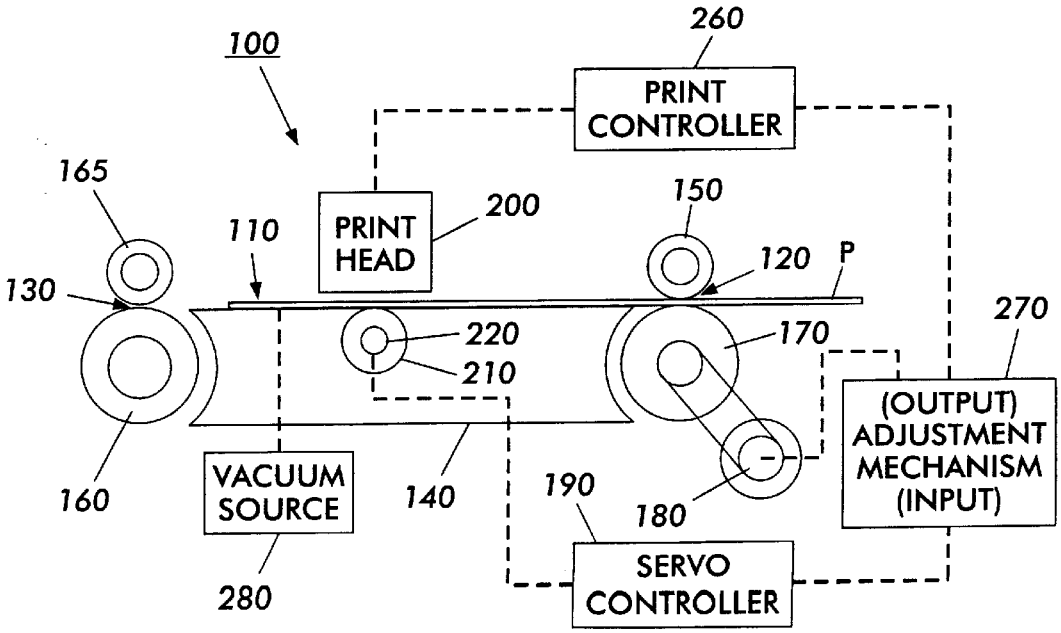
FIG. 4 is a side view of a third exemplary embodiment of the invention.
Figure 5:
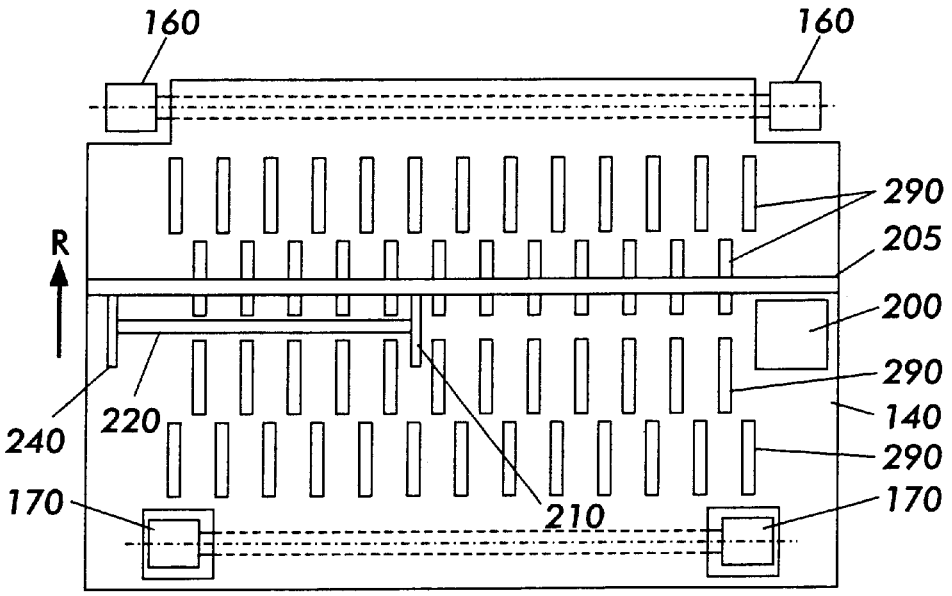
FIG. 5 is a top view of the vacuum platen and drive nips of FIG. 4.

The preferred embodiment of FIGS. 4–5 will be described in more detail. The media transport system includes platen 140 positioned in the area between the upstream drive nip 120 and the downstream drive nip 130. The platen 140 has a sheet media side with vacuum holes 290 and a vacuum force side that includes vacuum source 280. The vacuum force is generated by vacuum source 280 and applied to sheet media P through the vacuum holes 290 to draw the sheet media P against the sheet media side of platen 140.

Rollers 160 and 165 that form the downstream drive nip 130 are formed near lateral edges of the sheet, which are preferably, but not necessarily, outside of the printable region of the sheet region. This will prevent smearing of a printed image formed on the sheet media P by printhead 200. As the upstream drive nip 120 is prior to printing, rollers 170 and 150 do not necessarily have to be outside of the printable region of the sheet media.

In this embodiment, the sheet media P is advanced by a predetermined swath by upstream transport nip 120 across vacuum platen 150 to printhead 200. After advancement of the sheet media P, the printhead 200 is traversed laterally along a carriage 205 to print a swath of the image. After which, the sheet media P is advanced again until the entire image is printed. In a preferred embodiment using the latter example, the encoder roller 210 is positioned a small distance (such as, for example, 0.0020") into the transport path above the surface of platen 140 so that the vacuum force from vacuum source 280 biases the sheet media P into contact with encoder roller 210. The high friction material helps ensure that contact is maintained.

As the encoder roller 210 is to be driven by the sheet media P, which has very limited driving force, roller 210 should have minimal drag. This can be achieved by making the contact area small, such as by making the width T of the encoder roller 210 thin. The actual dimensions of the encoder roller will be determined based on the drive force generated by the sheet media P, which is dependent on several factors including the stiffness and frictional coefficient of the paper, the force generated by the upstream and downstream nips, drive force losses due to the vacuum, and other factors. The basic requirements for the encoder roller 210 are a low rotational drag, but a high coefficient of friction outer surface 210A.

Figure 7:
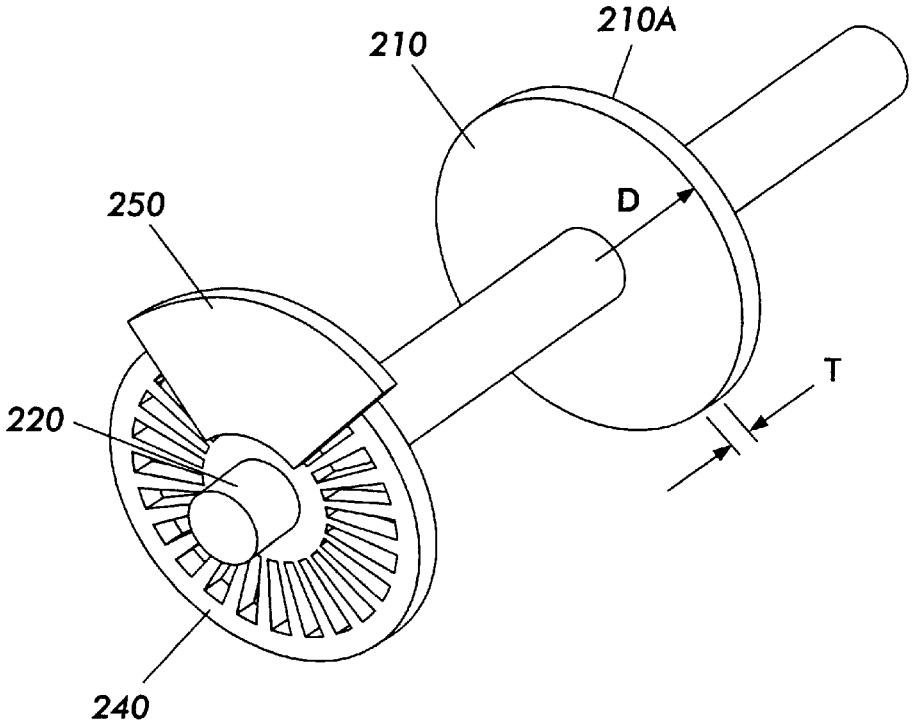
FIG. 7 is a perspective view of an exemplary encoder roller according to the invention.
Figure 8:
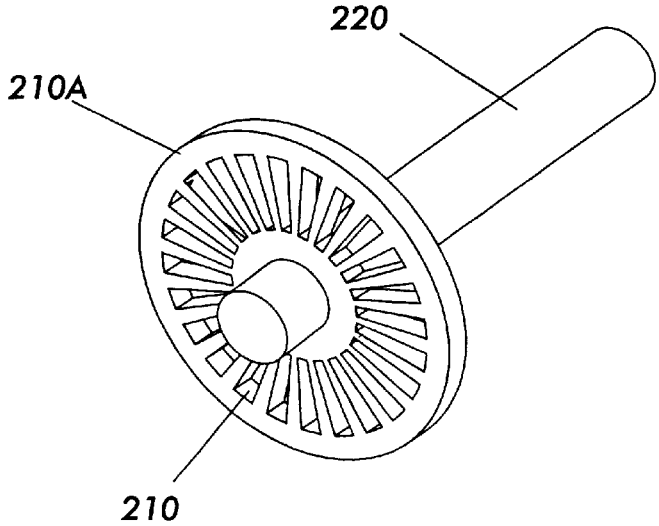
FIG. 8 is a perspective view of an exemplary encoder roller according to an alternative embodiment of the invention.

As exemplary encoder roller 210 is shown in FIG. 7. Encoder roller 210 includes an encoder that can accurately detect the angular rotation of encoder roller 210. This can take the form of a separate encoder wheel 240 (see FIG. 7) affixed to shaft 220 for rotation therewith along with encoder roller 210 or, alternatively, the encoder wheel can form encoder roller 210 itself (FIG. 8), with a high coefficient of friction material provided on the outer periphery 210A thereof. An encoder sensor 250 is mounted relative to encoder wheel 240 to detect rotation thereof. A particularly advantageous encoder is an encoder wheel 240 having a 20 mm diameter shaft and an encoder sensor 250 that has the capability of detecting 500 lines/revolution, which in quadrature results in 2000 pulses per resolution of precision. A suitable encoder capable of achieving this is a Hewlett Packard Series 9000 HEDS encoder. With such an encoder, an accuracy of 30 microns/pulse can be achieved, which is suitable for obtaining positioning accuracy of better than 21 microns for 600 SPI printing without visual quality defects. While an optical encoder wheel and sensor are illustrated, the invention can be implemented using any suitable or later developed capacitive, magnetic hall effect, inductive or optical encoder device.

In the exemplary embodiments shown in FIGS. 2–5, the encoder roller 210 (including encoder sensor 250) is connected to a servo controller 190 that receives the output from encoder roller 210, which is used to determine the position of sheet media P relative to an intended position. In these exemplary embodiments, the transport path 110 is controlled to advance the sheet media P by a calculated advancement, such as 1", by causing motor 180 to turn a predetermined number of steps, corresponding to 1" linear travel of the sheet media P by use of a servo motor 180 or a stepper motor 180. However, depending on the accuracy of the motor 180 and the adherence of the sheet media P relative to the nips 120, 130, the portion of the sheet media P opposed to printhead 200 may have been actually moved by more or less than 1".

As the encoder 210 is driven by the advancing sheet media P, the actual position of the advanced sheet media P can nonetheless be determined, regardless of whether the sheet media P encountered any slip relative to the advancement of the upstream or downstream drive nips 120, 130 during the advancement. That is, information from encoder 210 can be used as feedback to control image processing by an adjustment device 270, which can control any of a number of components or parameters thereof to correct for any detected misalignment.

For example, adjustment mechanism 270 can correction data to the motor 180, causing the motor 180 to further advance or retract, repositioning the sheet media P at an intended position. If a stepper motor 180 is provided, this can be achieved by sending a signal to advance the motor 180 by a certain number of steps in either direction (clockwise or counterclockwise). Alternatively, if the drive motor 180 is servo-controlled, the adjustment mechanism 270 can send a signal (feedback signal) overriding the signal from an encoder located at the drive roller 170 to cause the motor 180 to advance by a certain amount.

Figure 6:
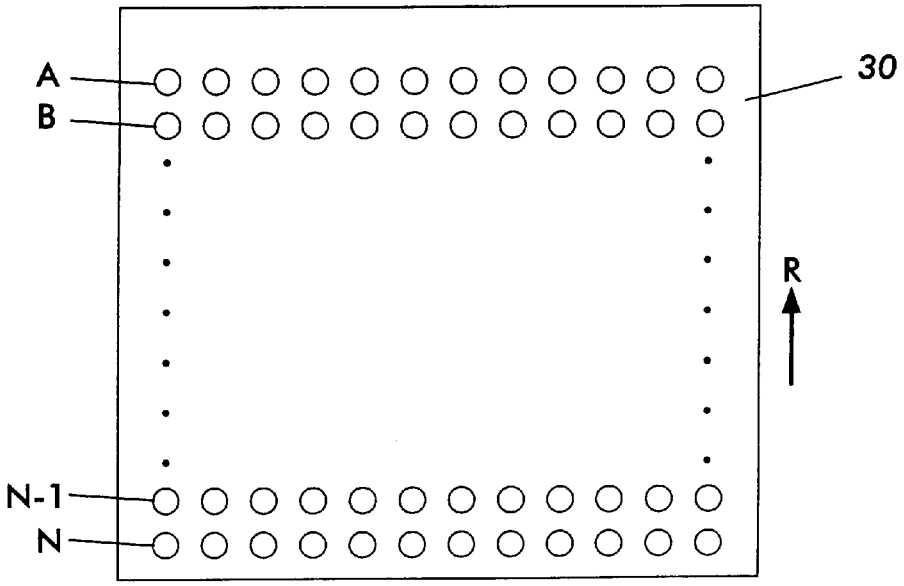
FIG. 6 is a bottom view of a carriage mounted printhead according to an exemplary embodiment of the invention.

Alternatively, adjustment device 270 can be electrically connected to print controller 260, which controls data flowing to printhead 200, to compensate for any misalignment. For example, an exemplary printhead has a resolution of 600 SPI and includes a matrix of print nozzles designed to print in the 1" swath as the printhead is advanced transverse to the transport direction of the device. Such a printhead is represented in FIG. 6, which is intended to be illustrative and not limited to a specific configuration.

Should the incremental advance be incorrect (i.e., slightly more or less than 1.0" advancement), then corrective action can be taken by adjustment device 270 so as to control the print controller 260 to adjust the firing of ink jet nozzles. As shown, illustrative printhead 200 has a two-dimensional array of nozzles of a particular resolution in rows A–N, where N can be any integer number. If, for example, the sheet media P is under advanced (i.e., less than 1"), then 1 or more rows of nozzles (A, A+B, etc.) can be controlled to not fire during that print swath. As such, a reduced swath is printed so that potential overlap in print coverage due to the under advancement can be avoided. If the nozzle array is sized to be more than the swath size (i.e., slightly more than 1"), then extreme end rows, such as A and N or A, B, N−1 and N, can be prevented from firing if advancement of exactly 1" is detected. With such a nozzle array that is longer than 1", over advancement can also be controlled by firing the intermediate nozzles plus the extreme end nozzles, either B and N−1 or A, B, N−1 and N. P. Accordingly, banding of ink or white spots between swaths can be avoided.

Alternatively, any combination of drive control and print control can be implemented. However, it may be preferable to have adjustment device 270 control the print controller rather than further movement of the transport system 110 for several reasons. First, further positioning requires additional time and slows throughput of the system. Second, when lower precision motors and drives are provided, this further positioning may also have positioning error, although inherently smaller as the distance being controlled is smaller. As such, it may be desirable to have the image to be printed at a particular position adjusted to fit into the area advanced so as to avoid ruined pages and poor visible images due to omissions in coverage or overlap.

The invention has been described with reference to specific embodiments, which are meant to be illustrative and not limiting. Various modifications can be made without departing from the spirit and scope of the invention as defined by the appended claims.

What is claimed is:

1. Apparatus for regulating sheet media position within a sheet media transport path formed between an upstream transport nip and a downstream transport nip that compensates for error in sheet media positioning, at least one of the upstream and downstream nips being driven by a drive mechanism, the apparatus comprising:

an encoder roller rotatably mounted between the upstream transport nip and the downstream transport nip so as to contact one side of a sheet media fed through the sheet media transport path, the encoder roller having an outer peripheral surface at least partly formed from a high coefficient of friction material and further including an encoder member that measures angular rotation of the encoder roller;

a biasing member positioned along the transport path between the upstream transport nip and the downstream transport nip at a location that biases the sheet media against the encoder roller, a combination of the high coefficient of friction material on the encoder roller and a biasing force of the biasing member being selected to prevent relative slip between the sheet media and the encoder roller and cause the encoder roller to be driven solely by a driving force generated by the sheet media as it is transported along the transport path;

a controller that determines sheet media misregistration by comparing output from the encoder roller with predicted registration; and an adjustment mechanism that compensates for any misregistration.

2. The apparatus of claim 1, wherein the biasing member is a thin flexure pressure finger.

3. The apparatus of claim 1, wherein the biasing member is an idler roller.

4. The apparatus of claim 1, wherein the biasing member includes a vacuum assisted transport belt.

5. The apparatus of claim 1, wherein a printing mechanism is located between the upstream transport nip and the downstream transport nip.

6. The apparatus of claim 5, wherein the printing mechanism is an ink jet printhead.

7. The apparatus of claim 1, wherein the adjustment mechanism outputs a feedback signal to control the driving of at least one of the upstream and downstream transport nips.

8. The apparatus of claim 1, wherein a printhead having a two-dimensional array of print nozzles is located along the transport path between the upstream and downstream transport nips and controlled by a printhead controller, the adjustment mechanism providing a signal to the printhead controller that adjusts printing by the two-dimensional array of print nozzles to compensate for any detected misregistration.

9. The apparatus of claim 8, wherein the adjustment mechanism prevents printing by one or more rows of the two-dimensional array of print nozzles to compensate for detected misregistration.

10. The apparatus of claim 1, wherein the encoder roller includes a narrow wheel rotatably provided on a shaft.

11. The apparatus of claim 10, wherein the encoder roller includes an optical rotary encoder mounted to the shaft.

12. A printing system, comprising:

an upstream transport nip;

a downstream transport nip;

a transport path defined between the upstream transport nip and the downstream transport nip that receives a sheet media fed from the upstream transport nip;

a drive member that drives at least one of the upstream transport nip and the downstream transport nip to cause the sheet media to be transported along the transport path;

a printhead located along the transport path positioned to print on the sheet media as it is fed along the transport path;

a print controller that controls the printing by the printhead on the sheet media;

an encoder roller rotatably mounted between the upstream transport nip and the downstream transport nip so as to contact one side of the sheet media fed through the transport path, the encoder roller having an outer peripheral surface at least partly formed from a high coefficient of friction material and further including an encoder member that measures angular rotation of the encoder roller;

a biasing member positioned along the transport path between the upstream transport nip and the downstream transport nip at a location that biases the sheet media against the encoder roller, a combination of the high coefficient of friction material on the encoder roller and a biasing force of the biasing member being selected to prevent relative slip between the sheet media and the encoder roller and cause the encoder roller to be driven solely by a driving force generated by the sheet media as it is transported along the transport path;

an encoder controller that determines sheet media misregistration by comparing output from the encoder roller with predicted positioning based on the drive member; and an adjustment mechanism that compensates for any misregistration.

13. The printing system of claim 12, wherein the printhead is an ink jet printhead.

14. The printing system of claim 12, wherein the drive member incrementally advances the sheet media by a predetermined amount.

15. The printing system of claim 14, wherein the encoder controller compares an actual travel amount of the sheet media as detected by the encoder roller with the predetermined amount and the adjustment mechanism compensates for any determined difference.

16. The printing system of claim 15, wherein the adjustment mechanism outputs a feedback signal to the drive member proportional to an a drive amount necessary to correct the misregistration.

17. The printing system of claim 15, wherein the printhead has a two-dimensional array of print nozzles and the adjustment mechanism provides a signal to the printhead controller that adjusts printing by the two-dimensional array of print nozzles to compensate for any detected misregistration.

18. The printing system of claim 16, wherein the adjustment mechanism prevents printing by one or more rows of the two-dimensional array of print nozzles to compensate for any detected misregistration.

19. The printing system of claim 12, wherein the encoder roller is closely adjacent the printhead to detect sheet media position substantially at a portion of the sheet media that will be printed.

20. The printing system of claim 12, wherein the biasing member is one of a pressure finger, an idler roller and a vacuum assisted transport belt.

* * * * *